United States Patent [19]

Vaden

[11] 4,070,088

[45] Jan. 24, 1978

[54] CONTACT CONSTRUCTION

[75] Inventor: James L. Vaden, Simi Valley, Calif.

[73] Assignee: Microdot, Inc., Greenwich, Conn.

[21] Appl. No.: 687,626

[22] Filed: May 18, 1976

Related U.S. Application Data

[63] Continuation-in-part of Ser. No. 602,015, Aug. 5, 1975, abandoned.

[51] Int. Cl.[2] ..... H01R 13/06

[52] U.S. Cl. ..... 339/252 R

[58] Field of Search ..... 339/252

[56] References Cited

U.S. PATENT DOCUMENTS

| | | | |
|---|---|---|---|
| 3,742,430 | 6/1973 | Cairns et al. | 339/252 R |
| 3,924,921 | 12/1975 | Feightner | 339/252 P |

FOREIGN PATENT DOCUMENTS

| | | | |
|---|---|---|---|
| 558,131 | 12/1957 | Belgium | 339/252 P |
| 1,273,013 | 1/1961 | France | 339/252 P |
| 809,169 | 12/1936 | France | 339/252 P |
| 342,948 | 2/1931 | United Kingdom | 339/252 P |
| 380,226 | 9/1932 | United Kingdom | 339/252 P |

*Primary Examiner*—Joseph H. McGlynn

*Attorney, Agent, or Firm*—Harness, Dickey & Pierce

[57] ABSTRACT

An electrical connector pin contact formed of a single blank of sheet metal including a pin section formed of a contoured strip-like portion extending outwardly from a main body part which includes a wire terminal portion to a rounded nose portion where it is folded back on itself to define two laterally spaced, medially bulged and oppositely longitudinally channeled arms, a free return end of the folded-back arm being engageable with but movable in relation to a part of the main body part to increase resistance of the bulged portions of the arms to movement toward each other when inserted in a mating socket contact. In one form the contact, which may be of either the pin or socket type, is insertable in and removable from its holder by pushing it into or out of holding engagement with a friction retaining portion.

6 Claims, 16 Drawing Figures

CONTACT CONSTRUCTION

REFERENCE TO RELATED APPLICATION

The present application is a continuation-in-part application of application Ser. No. 602,015, filed Aug. 5, 1975, now abandoned.

BACKGROUND OF THE INVENTION

The construction of pin and socket type connectors in the very small sizes utilized, for example, in multiple connector plugs for computer circuits, biomedical components and space technology, where the wire gauge may be as small as No. 30AWG and the contacts may be spaced on centers as close as 50 mils, entails severe difficulties, particularly with respect to the provision of sufficient strength so that the connectors can be repeatedly separated and reconnected, while still maintaining good electrical connection and resistance to vibration and other forces encountered in some services. It will be appreciated that the material used in such small connectors must inherently be bendable by forces which are relatively slight and apt to be encountered if any mishandling occurs. It has become the practice in the art to incorporate the flexibility which is required for the maintenance of good electrical contact in the male member, and to recess the male member in a relatively closely fitting insulating pocket, while the female member has sufficient rigidity to be self-supporting and to resist undesired distortion. A successful type of male connector pin which is currently used in the small sizes referred to and which affords very satisfactory performance is the so-called "twist pin," formed of expanded stranded conductor material, but the cost of construction thereof is relatively high, so that in some fields of use where the cost of the pins of such construction is not justified, a strong need exists for a contact pin capable of comparable performance but which can be manufactured at substantially lower cost.

The overall object of the present invention is to provide an improved contact pin construction suitable for use in micro-circuitry and in connectors of very small sizes, as indicated, and which is highly reliable, capable of repeated connection and disconnection, resistant to distortion and to the forces of vibration and acceleration encountered in service, and which is substantially less expensive to manufacture than the so-called "twist-pin" construction.

Other objects and advantages will become apparent upon consideration of the present disclosure in its entirety.

BRIEF DESCRIPTION OF THE FIGURES OF DRAWING

Figure 1:
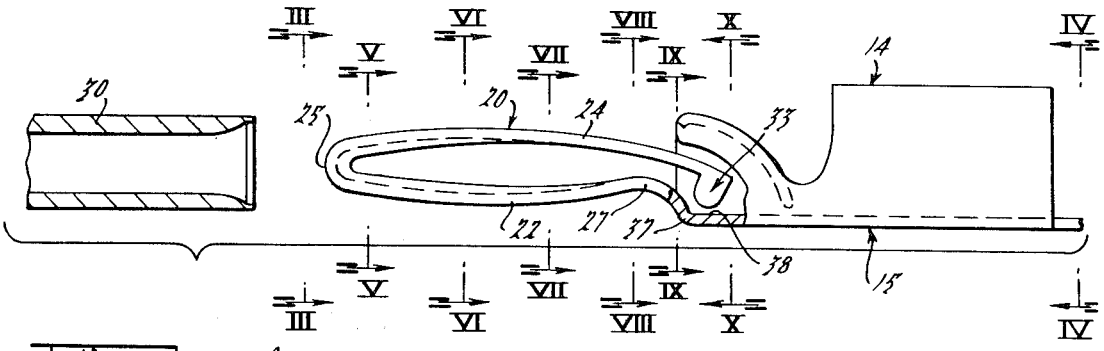
FIG. 1 is a view partly in side elevation and partly in section, with a portion broken away, showing a contact assembly incorporating the present invention, with the parts separated.
Figure 11:
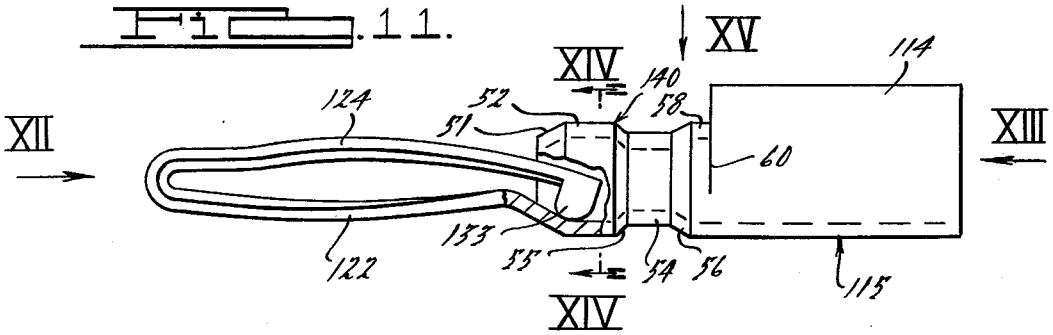
Figure 14:
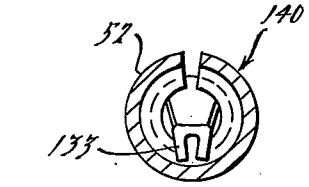
Figure 15:
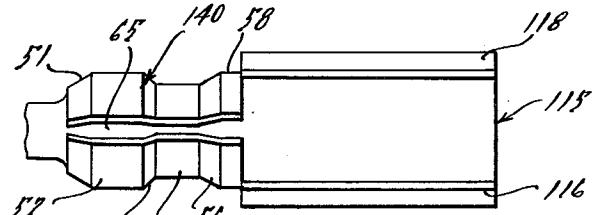
Figure 13:
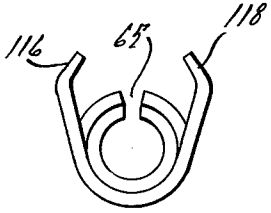
Figure 12:
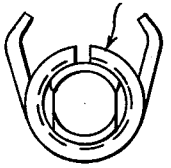

FIGS. 5 through 10 inclusive are shallow sectional views taken, respectively, on the lines and arrows designated by corresponding Roman numerals in FIG. 1;

FIG. 11 is a side elevation, partly broken away, of a contact pin of modified construction;

FIGS. 12 and 13 are end elevational views taken as indicated by the arrows designated XII and XIII, respectively, in FIG. 11:

FIG. 14 is a cross section taken substantially on the line XIV—XIV of FIG. 11 and looking in the direction of the arrows;

FIG. 15 is a top plan view, partly broken away; and

Figure 16:
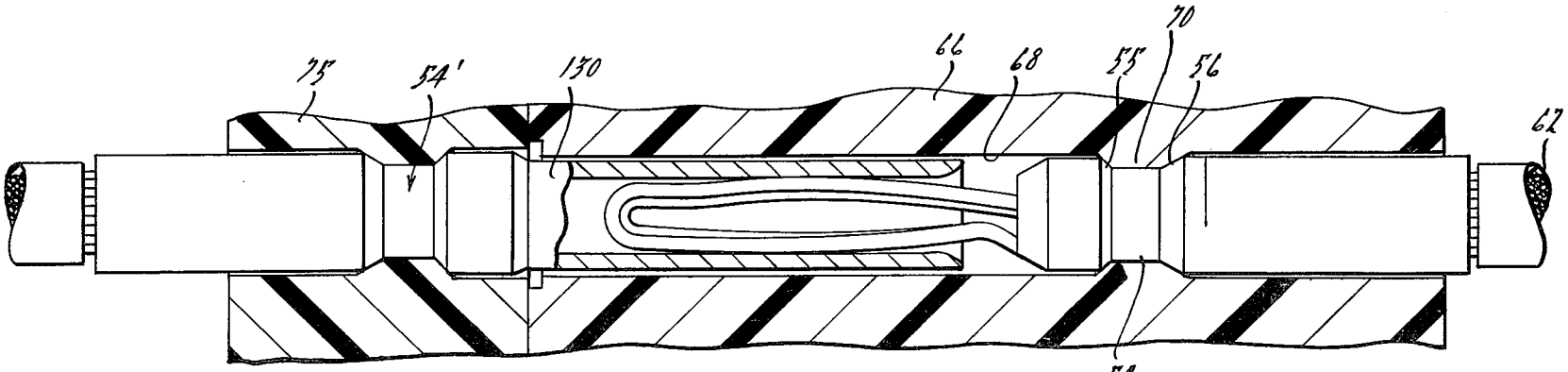

FIG. 16 is a sectional elevational view, partly broken away, of pin and socket portions of the modified construction installed and interengaged.

DETAILED DESCRIPTION OF THE PREFERRED FORMS OF THE INVENTION

The pin connector shown in the drawing is formed of a single blank of a suitable resilient sheet metal, such as a copper-nickel-zinc alloy, such materials being well known in the art. The portion for connection to the electrical conductor is shown at the right in FIGS. 1 and 2 and is indicated as comprising a crimpable tube-defining wire terminal section 14 comprised of ear flanges 16, 18, forming part of a relatively rigid main body generally designated 15. In the initial condition shown, prior to attachment of the conductor, the section 14 has a generally U-shaped cross section, the side flange or web portions 16, 18 being adapted to be folded inwardly toward each other and then down toward bight portion 19 upon the wire to tightly engage it and complete an electrical connection. This type of wire connecting means is also known in the art. It will be appreciated that other known types of wire terminal portions may also be used, such as solder-types, or alternatively an integral pigtail formed of the same sheet metal might be used.

Figure 2:
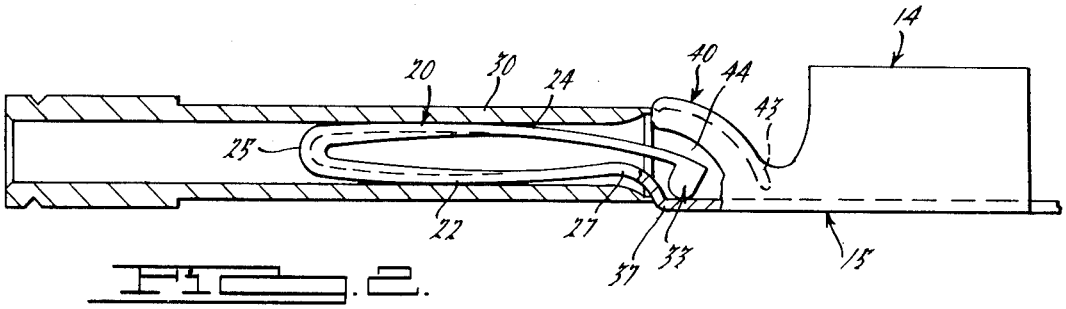
FIG. 2 is a similar view with the parts engaged.
Figure 5:
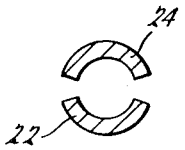
Figure 6:
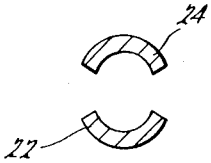
Figure 7:
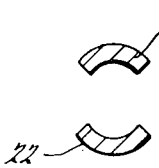

The contact pin portion, generally designated 20, and shown as extending to left in FIGS. 1 and 2, is comprised of a narrow cantilever beam-type doubled strip, including a supporting arm 22 which is integral with, and at its outer end is folded back upon itself to form, a return arm 24. The free end of the return arm 24 extends back far enough to partially overlie the bottom of the main body 15. The main body constitutes a relatively rigid combined supporting and connection portion. As brought out in sectional views 5, 6 and 7, the arms 22, 24 are channeled longitudinally to an arcuate cross section from their outer ends to positions relatively close to the combined supporting and connection portion 15, such arms having their concave portions facing each other. Preferably the chaneling of the arms is such that the pin can mate with a standard twist-pin socket.

The return-bent portion 25 at the outer end of pin section 20 is curved around a radius, so that such portion 25, constituting the nose of the connector, is of a modified partly spherical form. The arms 22, 24 are also bowed apart in their mid regions so that the maximum diameter defined thereby exceeds the internal diameter of the socket connector portion 30 sufficiently so that a desired contact pressure is created when the pin is inserted, as shown in FIG. 2.

The free end of return arm 24 is formed with a pair of integral downturned ears 34, 35 defining a rockable and slidable abutment generally designated 33. Abutment 33 projects into an intermediate section 40 of the connector. Section 40 constitutes a relatively rigid continuation of the wire terminal portion 14 lying between the terminal portion 14 and the pin portion 20. The intermediate section 40 has walls 41, 42 folded to a substantially circular cross section and which approximately define a hemisphere open at its end facing the pin section 20.

Figure 8:
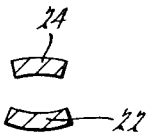
Figure 9:
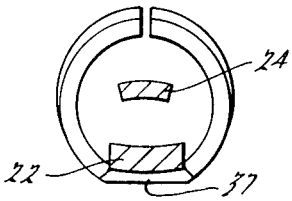
Figure 10:
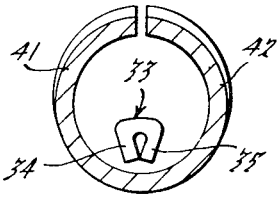
Figure 3:
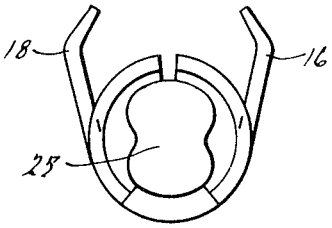
FIG. 3 is an end elevational view taken as indicated by the line and arrows III—III of FIG. 1 and looking in the direction of the arrows.
Figure 4:
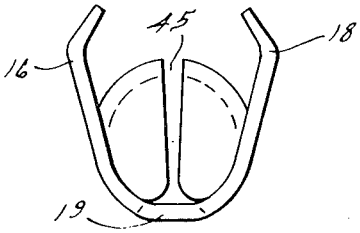
FIG. 4 is an end elevational view taken as indicated by the line and arrows IV—IV of FIG. 1 and looking in the direction of the arrows.

As brought out in FIGS. 8 and 9, the arcuate cross section of the supporting arm 22 in the region designated 27 grauatedly increases in radius toward its juncture at the position 37 with the bottom wall of the main body, at which position it is more nearly straight transversely, as brought out in FIG. 9. A controlled degree of stiffness, to support the pin during insertion, and of flexibility, to assist alignment during insertion, are thereby provided.

The resiliency of the pin portion 20 is such that as shown in FIG. 1, the arm 24, when not engaged in the female contact element, is spaced apart from the arm 22, and at such time the abutment portion 33 is free of engagement with the bottom of intermediate section 40. However, when the arms are forced together by insertion in the socket, as 30, the abutment portion 33 is driven against an abutment area 38 on the bottom wall prior to the completion of compression of the arms, and such engagement between the abutment portions 33-38 opposes the compressive forces exerted on the arms, thereby increasing the engagement pressure and the effectiveness of the electrical connection. Such engagement also offsets any tendency of the arm 24 to oscillate in event the assembly is subjected to severe high-frequency vibration.

It will also be noted that the ears 34, 35 are rounded, as viewed in side elevation, so that they can rock and slide on the bottom of chamber portion 44 during compression and release of the arms.

The folded-over upper rear portions of walls 41, 42 of section 40, closest to wire terminal portion 14, extend downwardly as indicated at 43 to a position close to the bottom or bight wall portion, to substantially isolate the chamber area 44 within the section 40 from the wire-receiving area between the legs 16, 18 of section 14. The side walls of the portion 40 surround the abutment portion 33 and the free end of arm 24, so that when a plurality of the contact members are placed together in a bin, are tumble-plated, or otherwise grouped in a random arrangement, the terminals cannot become linked. During the course of securing the wire in section 15, wall portions 43 prevent the inadvertent protrusion of the wire into the abutment portion 33 which might interfere with its free movement. The gap at 45 is sufficiently small to achieve the desired isolation. As the contact is installed in a suitable housing (not shown) the contact cavity walls bear on wall portions 41 and 42, the gap at 45 is reduced, and the abutment portion 33 is further isolated from the terminal portion 14. Epoxy, frequently used as a means of securing the contact in the housing, will be blocked at 43. The forces on wall portions 41 and 42 when the unit is inserted in the housing, however, will provide sufficient contact retention in normal handling during the manufacturing processes to preclude the need for special fixtures, so-called "Dot Epoxy" or "crimp to fit" as commonly known in the trade.

Because of the design of the arm portions 22 and 24, gold can be applied in a very efficient and economical manner, if desired by the designer for maximum contact efficiency, since the contacting areas are definite and relatively wide as compared, for example, with the wire-type contact areas of a twist-pin-type contact. Dimpling for a dot of gold can thus be used in a manner which confines the gold to the contact area.

In the modified construction shown in FIGS. 11–16 the main body portion 115 is provided with an intermediate section generally designated 140 which is of circular cross section throughout, and which has at its forward end an inwardly tapered annular wall 51 which the supporting arm 122 is integrally attached. The return arm 124, similarly to the first embodiment, extends rearwardly and projects through the open forward end of the conically tapered portion 51, carrying within the intermediate section 140 an abutment portion 133 which is similarly rockable and slidable upon the interior wall of the intermediate section 140. Although in this embodiment the abutment portion 133 is not initially out of engagement with the portion of section 140 which it overlies, it will be recognized that action similar to that of the first embodiment occurs as it is forced into engagement with the body more tightly when the pin is inserted in the socket contact. In the specification and claims hereof, references to the fact that these parts are forced into engagement are to be constructed as applicable whether or not they are touching when the pin is not in a socket.

Rearwardly of the conic section 51 the intermediate section 140 has a substantially cylindrical portion 52 between which and the main connector portion 114 is a necked-in section defined by a reduced central cylindrical part 54. A generally conic wall portion 55, joins the reduced section 54 to the portion 52 and another conically tapered wall portion 56 joins the rear end of the reduced part 54 to a short cylindrical rearwardly extending part 58. The connector portion 114 consists of wrappable parts 116, 118 corresponding to the leg flange portions 16, 18 of the first-described embodiment but separated from the intermediate portion 140 by slits 60, so that when the portions 116, 118 are wrapped and compressed onto the conductor 62, the intermediate section 140 is not thereby distorted. A slot 65 extends the full length of the intermediate section 140, to permit compressive and expansive flexing of its walls during insertion and removal of the connector with respect to a supporting body.

A supporting body, which may typically be a part of a multi-connector plug, is shown at 66 in FIG. 16. The body 66 is formed of a somewhat yieldable but essentially rigid insulating plastic containing a generally cylindrical passage 68 extending therethrough, proportioned to receive and fit relatively snugly around the connector body, which when the portions 116, 118 are wrapped and compressed upon the conductor has a substantially cylindrical shape which is of uniform diameter except for the necked-in portion and the conical front end 51. As shown in FIGS. 11 and 16 the forward sloping portion 55 is at a greater angle to the axis (e.g., 45°) than the rearward sloping portion 56 which is inclined at approximately 30°. The contact receiving opening 68 in the body 66 is provided with an annular internal rib 70 shaped and proportioned conformably to the neck defined by the sloping portions 55, 56 and reduced portion 54. The resiliency of the material of the body 66, and the resilient compressibility of intermediate portion 140 due to the slot 65 are such that the contact can be pushed into the installed position shown in FIG. 16 in which the rib 70 snaps into the necked-in portion to frictionally retain the contact in the body 66. Due to the steeper inclination of the forward sloping portion 55, the displacement of the contact with respect to the insulating body is effectively resisted as the contact arms 122, 124 are forced into the tubular socket contact element 130 designed to mate therewith, although the retention is also sufficient to enable the mating contacts to be pulled apart without displacing them in their holders. A detent action is thus provided by the radial yieldability of the parts and the inclined surfaces of parts 55, 56, 70. As shown in FIG. 16, the socket contact element 130 is also provided with a necked-in portion, generally designated 54' whereby it is similarly frictionally retained in but removable from the complementary supporting body 75 for the socket contact. body 75 for the socket contact.

This Detailed Description of the Preferred Forms of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A contact pin structure intended for removable insertion in a contact socket, said pin structure comprising a body portion, integral pin-defining means comprising a supporting arm projecting longitudinally from the body portion to a nose area spaced from the body portion and folded back at said nose area to define an integral return arm spaced from the supporting arm, said return arm having a free end which overlies the body portion, both of said arms being medially bowed oppositely outwardly away from each other and being longitudinally channeled, with the concave sides of the channels facing each other, said pin-defining means being formed of resilient electrically conductive material, and a pair of coacting abutment portions one of which is formed on the body portion and the other of which is carried by the free end of the return arm, said abutment portions being urged together laterally, the abutment portion on the return arm being rockable and slidable relatively to the body portion, when the pin-defining means is pushed into a socket which forces the medial portions of the arms toward one another, and a covering part on the body portion extending transversely of and around the free end of the return arm and outspaced from the free end of the return arm.

2. A contact pin structure as defined in claim 1 wherein the covering part is provided with longitudinally oppositely inclined external detent portions including a forwardly facing tapered portion for assisting entry of the pin structure into a supporting body and a rearwardly facing more steeply inclined tapered portion for opposing movement of the pin structure out of the supporting body.

3. A contact pin structure as defined in claim 2 formed of sheet metal and wherein said body portion includes a terminal portion at its end opposite said arms and an intermediate section wrapped to substantially circular tubular form and incorporating said covering part and said detent portions.

4. A contact pin structure as defined in claim 3 wherein said intermediate section is slightly less than 360° in peripheral extent whereby a longitudinal slot is provided which permits radial compression thereof to augment the frictional holding effect of the detent portions when the intermediate section is forced into a suitably-sized orifice in a supporting body.

5. A contact pin structure as defined in claim 4 wherein said slot is positioned approximately 180° from the position of engagement of said abutment portions.

6. A contact pin structure intended for removable insertion in a contact socket, said pin structure comprising a body portion, integral pin-defining means comprising a supporting arm projecting longitudinally from the body portion to a nose area spaced from the body portion and folded back at said nose area to define an integral return arm spaced from the supporting arm, said return arm having a free end which overlies the body portion, the return arm being medially bowed away from the supporting arm, said pin-defining means being formed of resilient electrically conductive material, and a pair of coacting abutment portions one of which is formed on the body portion and the other of which is carried by the free end of the return arm, said abutment portions being urged together laterally, and the abutment portion on the return arm being rockable and slidable relatively to the body portion, when the pin-defining means is pushed into a socket which forces the medial portions of the arms toward one another, a covering part on the body portion spacedly surrounding the free end of the return arm, said arms having portions spaced from the body portion which are longitudinally channeled to substantially arcuate cross section, with the concave sides of the channels facing each other, the mid portions of said arms being oppositely outwardly bowed away from each other, the part of the abutment portion on the return arm which engages the other abutment portion being rounded and rockable and slidable relatively to such other abutment portion.

* * * * *